US012752995B1

(12) United States Patent
Dan

(10) Patent No.: US 12,752,995 B1
(45) Date of Patent: Oct. 6, 2026

(54) FLEXIBLE UPRIGHT POUCH WITH IMPROVED TRIPLE POINT SEAL

(71) Applicant: American Fuji Seal, Inc., Bardstown, KY (US)

(72) Inventor: Yuma Dan, Jeffersonville, IN (US)

(73) Assignee: American Fuji Seal, Inc., Bardstown, KY (US)

( * ) Notice: Subject to any disclaimer, the term of this patent is extended or adjusted under 35 U.S.C. 154(b) by 0 days.

(21) Appl. No.: 19/314,704

(22) Filed: Aug. 29, 2025

(51) Int. Cl.
*B65D 75/58* (2006.01)
*B65D 75/32* (2006.01)

(52) U.S. Cl.
CPC ..... *B65D 75/5866* (2013.01); *B65D 75/322* (2013.01)

(58) Field of Classification Search
CPC ..... B65D 75/322; B65D 75/5866
USPC ..... 383/104
See application file for complete search history.

(56) References Cited

U.S. PATENT DOCUMENTS 3,512,700 A * 5/1970 Evans ..... B65D 31/00 383/120
3,799,914 A * 3/1974 Schmit et al. ..... B65D 75/008 426/115
4,718,738 A * 1/1988 Bell ..... B65D 75/008 206/0.8
4,904,093 A * 2/1990 Woods ..... B65D 31/02 383/122
4,950,859 A * 8/1990 Anderson ..... B65D 81/3461 426/243
5,468,206 A * 11/1995 Buchanan ..... B65D 31/005 493/194
6,076,967 A * 6/2000 Beaudette ..... B65D 75/008 383/41
6,120,183 A * 9/2000 Buchanan ..... B31B 70/00 383/122
6,303,363 B1 * 10/2001 Ward ..... C12M 99/00 435/243
6,921,203 B2 * 7/2005 Versluys ..... B65D 75/008 383/104
7,452,132 B2 * 11/2008 Tang ..... B65D 81/2038 383/103
9,650,178 B2 * 5/2017 Maglio, Jr. ..... B65D 33/2508
D879,563 S * 3/2020 Xu ..... D7/602
2002/0094922 A1 * 7/2002 Edwards ..... B65D 33/065 383/104
2002/0094923 A1 * 7/2002 Edwards ..... B65D 33/16 383/104

(Continued)

*Primary Examiner* — Peter N Helvey
(74) *Attorney, Agent, or Firm* — FBT Gibbons LLP

(57) ABSTRACT

A pouch-type container includes a front sheet, a rear sheet, a bottom gusset, a seal, and a triple-point. The front sheet, the rear sheet, and the bottom gusset are configured to define a storage area for containing a packaged substance between the front sheet, the rear sheet and the bottom gusset. The seal is defined by the front sheet, the rear sheet, the bottom gusset, or a combination thereof. The triple-point is defined by a least a portion of the seal at an intersection between the front sheet, the rear sheet, and the bottom gusset. The triple-point includes an inflection feature. The inflection feature includes a first inflection radius and a second inflection radius. The first inflection radius being separated from the second inflection radius by a distance greater than 1.5 mm.

13 Claims, 8 Drawing Sheets

(56) References Cited

U.S. PATENT DOCUMENTS

| | | | | |
|---|---|---|---|---|
| 2002/0110291 | A1* | 8/2002 | Edwards | B65D 75/5877 383/104 |
| 2002/0141663 | A1* | 10/2002 | Edwards | B65D 33/065 383/104 |
| 2003/0138169 | A1* | 7/2003 | Bell | B65D 75/5805 383/7 |
| 2004/0091182 | A1* | 5/2004 | Versluys | B65D 75/008 383/104 |
| 2008/0240626 | A1* | 10/2008 | Bell | B65D 31/10 53/396 |
| 2010/0016825 | A1* | 1/2010 | Graf | A61J 1/10 604/416 |
| 2014/0185966 | A1* | 7/2014 | Umenaka | B65D 83/28 493/189 |
| 2014/0248005 | A1* | 9/2014 | David | B65D 75/008 383/104 |
| 2015/0125097 | A1* | 5/2015 | Kenmotsu | B65D 33/16 383/42 |

* cited by examiner

FLEXIBLE UPRIGHT POUCH WITH IMPROVED TRIPLE POINT SEAL

BACKGROUND

Flexible pouches may be used for storage of a variety of stored media such as food products, medical products, chemical products, and/or etc. Such pouches may be configured in a variety of forms. One such configuration is an upright or inverted pouch. In an upright pouch, a rigid or semi-rigid cap is positioned on the bottom of the pouch. The cap is configured to serve dual functions as a base and a sealable spout for release of stored media within the pouch. Other portions of the pouch may be flexible to enhance evacuation of the stored media from the pouch through the sealable spout.

Such pouches may include one or more sheets coupled together to define an internal storage area and to provide structural stability to the pouch. Coupling may be achieved through the use of one or more seals formed in the perimeter of the pouch. In some circumstances a seal called a triple-point seal may join three sheets or panels together.

DESCRIPTION OF DRAWINGS

While the specification concludes with claims which particularly point out and distinctly claim the invention, it is believed the present invention will be better understood from the following description of certain examples taken in conjunction with the accompanying examples and figures.

Figure 1:
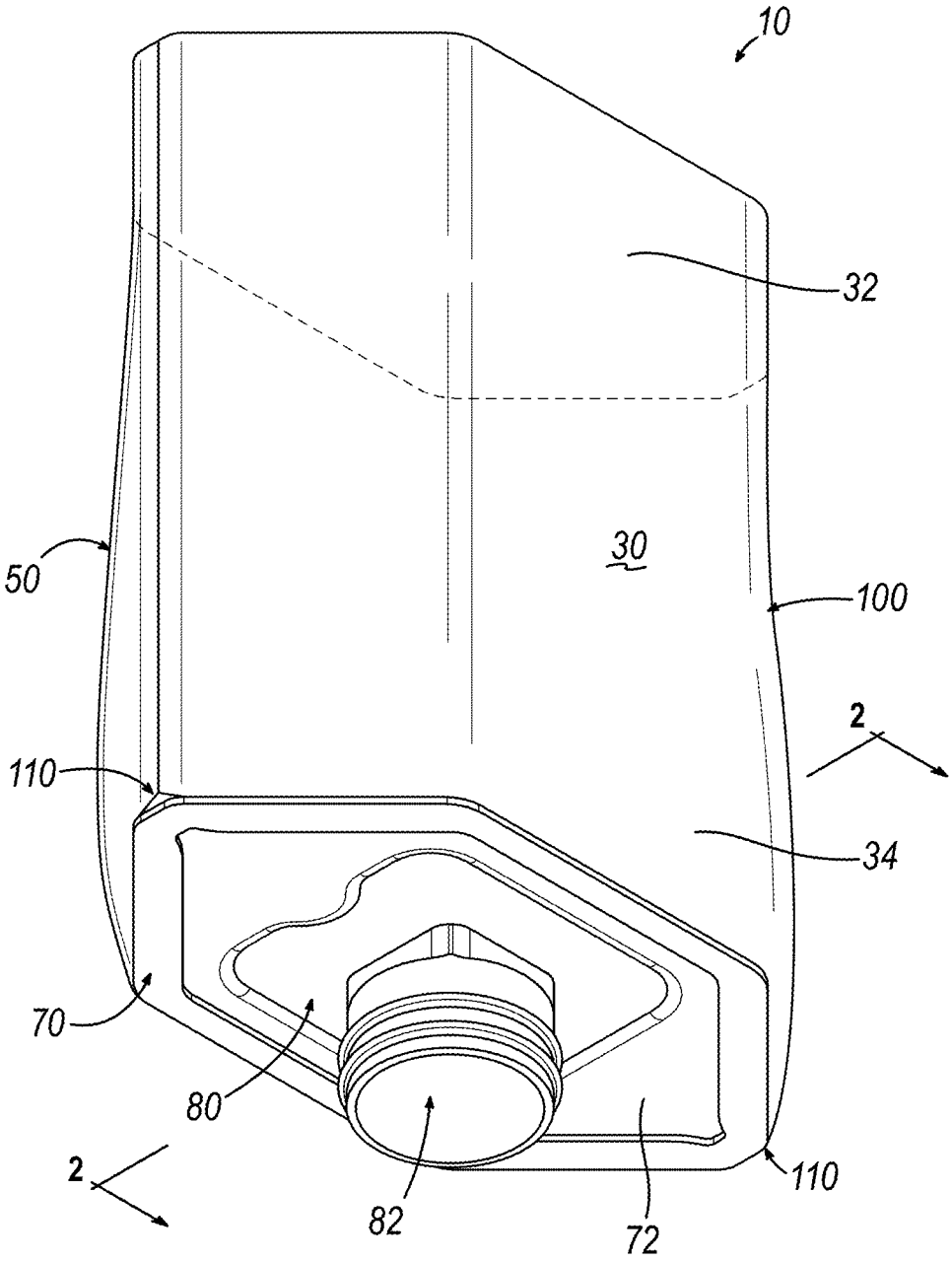
FIG. 1 depicts a perspective view of a pouch configured for containing a stored product.

The figures are not intended to be limiting in any way, and it is contemplated that various embodiments of the invention may be carried out in a variety of other ways. The accompanying figures incorporated in and forming a part of the specification show aspects of the present invention, and together with the description serve to explain the principles of the invention; it being understood, however, that this invention is not limited to what is shown in the figures.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the examples, figures, and descriptions should be regarded as illustrative in nature and not restrictive.

With some flexible pouches where a number of panels are being joined, problems may arise in the integrity of the seal formed at the triple-point due to current manufacturing limitations in terms of materials, material handling, and other processes. The result can be excess manufacturing defects and waste and/or product quality issues in terms of leaks at the seals around the triple-point. Therefore, it would be desirable to include one or more features in the pouch at or around the triple-point seal to better accommodate for variations in the manufacturing process to facilitate robust manufacturing with less waste, fewer defects, and fewer product quality issues.

The following description details features for incorporation into a pouch-type container to enhance the robustness of one or more seals included therein and to improve manufacturability. For instance, in one pouch-type container configuration known as an upright or inverted pouch—where the pouch is configured with a cap that also serves as a base for the pouch so it stands upright on a surface—one or more sheets are coupled together to form one or more seals in the structure of the pouch-type container. Seals where multiple sheets are coupled together may exhibit some challenges due to tolerances in sheet dimensions and/or tolerances in manufacturing processes leading to variation in individual seal geometries relative to as-designed seal geometries. Thus, it may be desirable to include one or more features in the configuration of the seal or individual sheets making the seal to accommodate such variation. Such features may permit at least some variation in sheet size and relative position while maintaining acceptable seal quality, and may further provide for a larger window for manufacturability. In one more specific example, a triple-point seal joins three or more sheets, panels, or other structural components together. With the introduction of one or more geometric features, as will be described further below, into the regions of the sheets forming the triple-point, greater tolerance of variation may be achieved, resulting in acceptable seal quality despite variation in sheet dimensions.

Although the features described herein are in the context of an upright pouch configuration, it should be understood that the same features may be readily applied to other pouch-type container configurations. Indeed, features and concepts described herein may be readily applied to any other suitable pouch-type container where multiple sheets, panels, or other structural components may be joined together.

Figure 2:
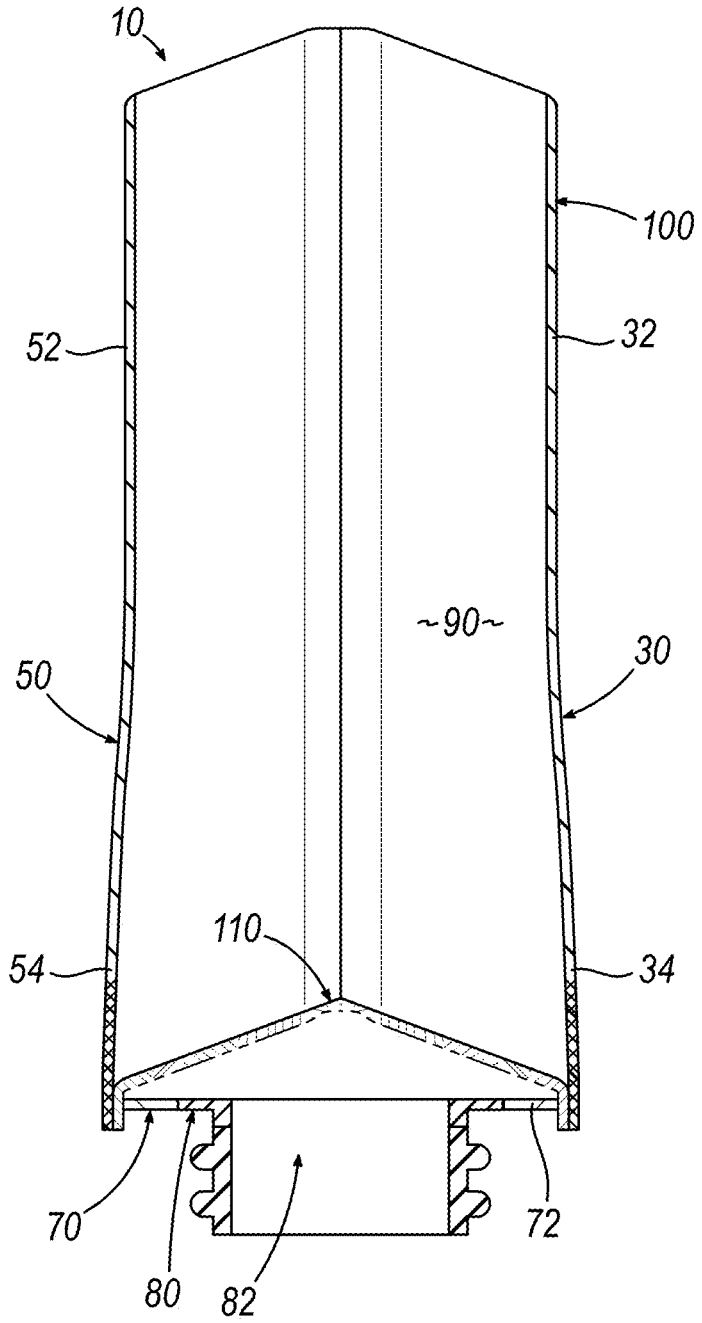
FIG. 2 depicts a side cross-sectional view of the pouch of FIG. 1.

Referring now to the figures, FIG. 1 shows an illustrative pouch (10) (also referred to as a pouch-type container), which is configured to contain any suitable stored product or media such as food products, medical products, chemical products, and/or etc. Pouch (10) includes a front sheet (30) (also referred to as a front panel), a back sheet (50) (also referred to as a back panel), and a gusset (70). As best seen in FIG. 2, front sheet (30), back sheet (50) and gusset (70) are generally secured together to define a storage area (90) configured for containing the stored product between front sheet (30), back sheet (50) and gusset (70). Thus, front sheet (30), back sheet (50), and gusset (70) are generally coupled together in a fluid tight arrangement to promote containment of the stored product within the storage area (90).

Figure 3:
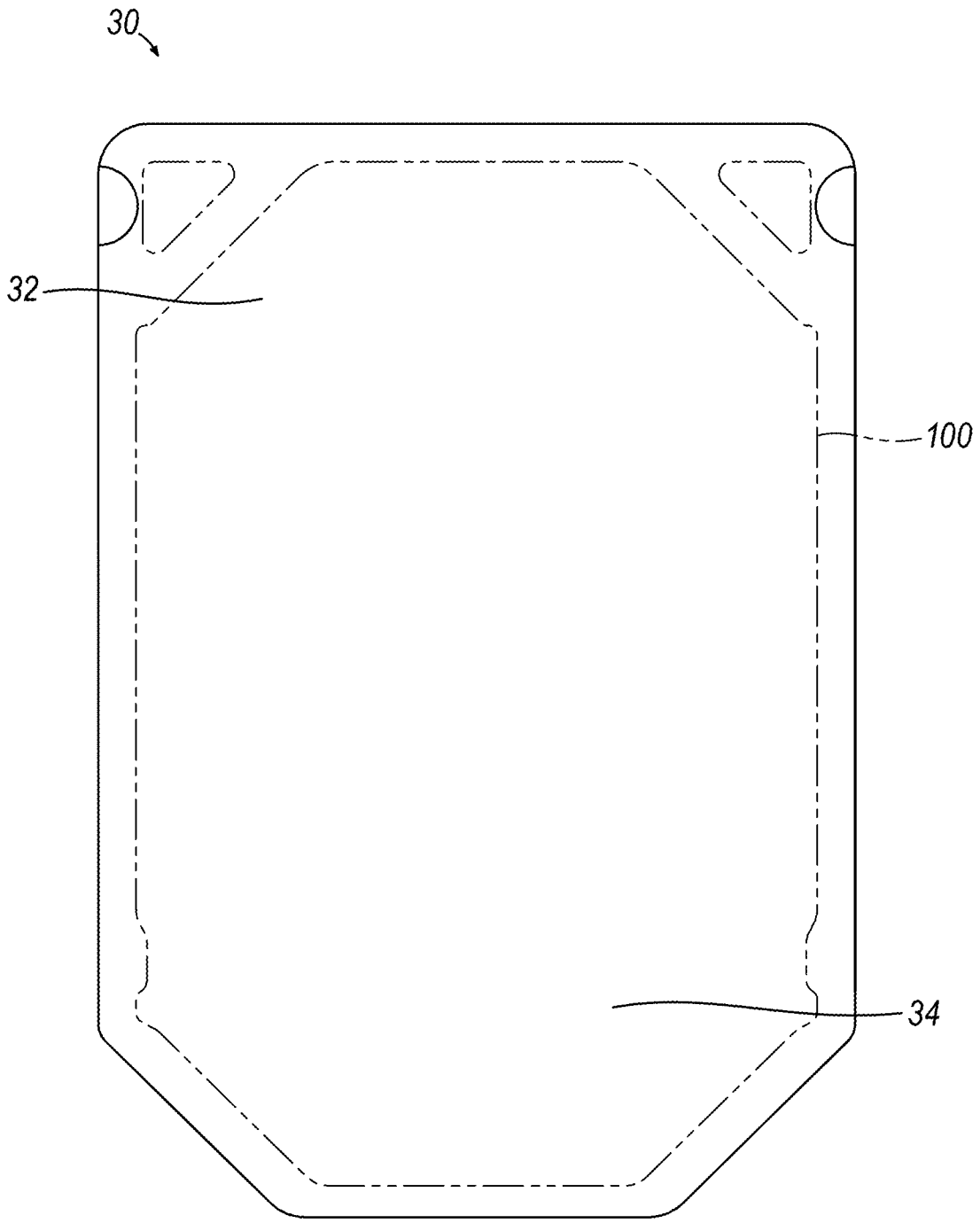
FIG. 3 depicts a front elevational view of a front sheet for formation of the pouch of FIG. 1.
Figure 4:
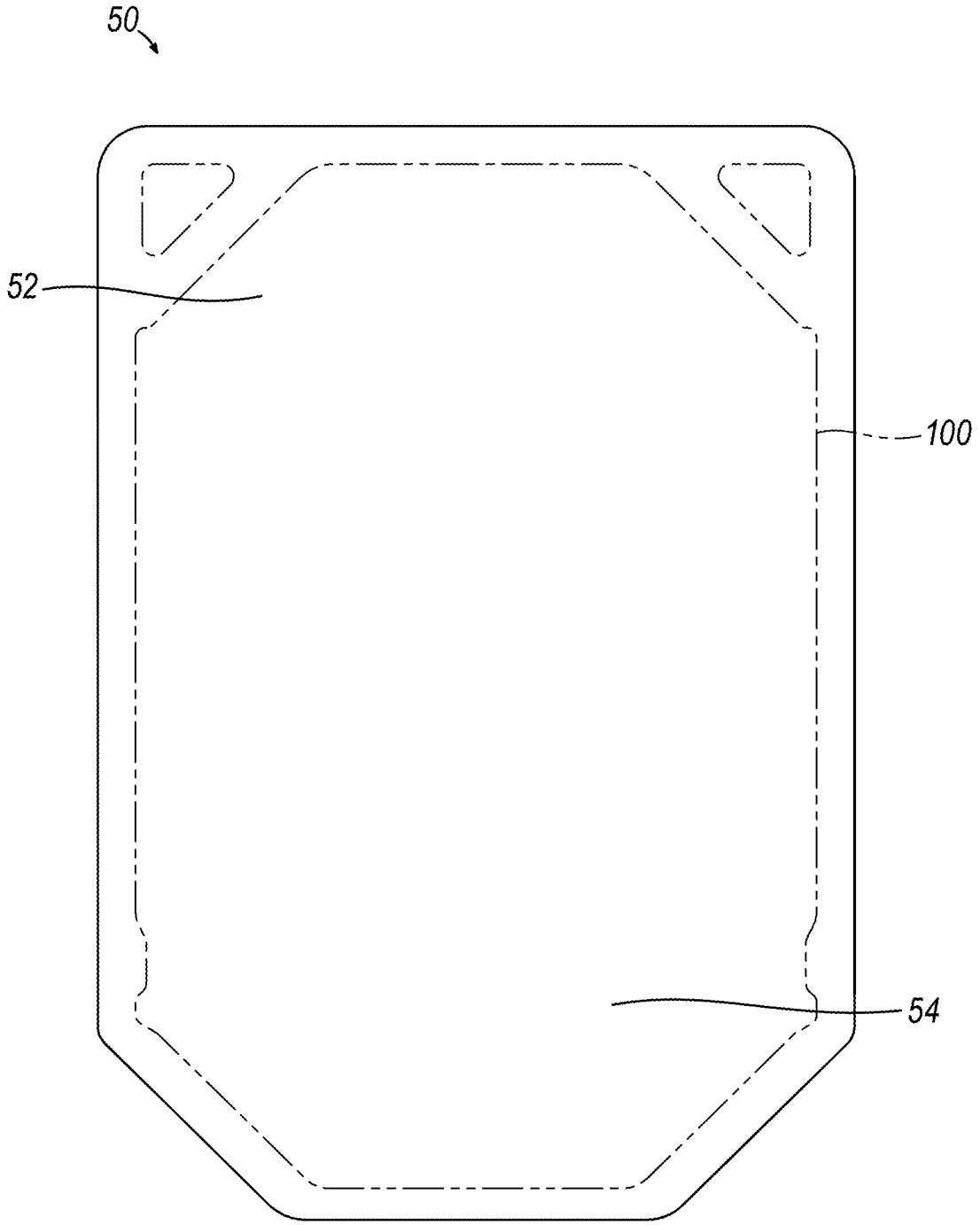
FIG. 4 depicts a rear elevational view of a back sheet for formation of the pouch of FIG. 1.

Front sheet (30) and back sheet (50) are both generally substantially identical in shape. Thus, FIGS. 3 and 4 show substantially similar sheets (30, 50). Generally, it may be desirable for at least some correspondence between front sheet (30) and back sheet (50) to promote ease of manufacturability because this may reduce the number of distinct parts used for formation of pouch (10), while also simplifying the overall design and manufacturing processes. Although front sheet (30) and back sheet (50) are of a generally substantially identical configuration herein, it should be understood that in other examples, front sheet (30) and back sheet (50) may have distinct shapes relative to each other.

As best seen in FIGS. 3 and 4, front sheet (30) and back sheet (50) define a generally rectangular shape with rounded or curved corners. Each of front sheet (30) and back sheet (50) include a respective top portion (32, 52) and bottom portion (34, 54). In the present example, top portion (32, 52) defines generally square edges relative to each other to define a generally straight upper edge of pouch (10). Meanwhile, bottom portion (34, 54) defines a generally tapered shape with a pair of angled edges on each side projecting downwardly and inwardly toward a straight bottom edge. As will be described in greater detail below, the more complex geometry of bottom portion (34, 54) relative to top portion (32, 52) is generally desirable to facilitate coupling of bottom portion (34, 54) to gusset (70). Additionally, the tapered geometry of bottom portion (34, 54) may be desirable to provide an overall tapered shape to pouch (10), which may enhance the complete discharge or expulsion of stored product from storage area (90).

Both front sheet (30) and back sheet (50) are formed of a flexible yet durable material or composite of multiple materials. The use of a flexible material for front sheet (30) and back sheet (50) is generally desirable to permit the volume of pouch (10) to increase for storage of stored product within storage area (90) while also permitting a manual decrease in volume for discharge or expulsion of stored product. Additionally, a flexible material may be desirable to permit compaction of pouch (10) for disposal. Suitable flexible materials for front sheet (30) and back sheet (50) may include plastics such as polyethylene, metals such as aluminum, paper products such as wax paper, or various combinations thereof.

It should be understood that both front sheet (30) and back sheet (50) may initially be provided in a blank form with front sheet (30) and back sheet (50) being cut in the shape as shown in FIGS. 3 and 4, but otherwise of a uniform material structure, although a uniform material structure may not be required in all versions. As will be described in greater detail below, a seal (100) may be added to both front sheet (30) and back sheet (50) during manufacturing of pouch (10) using a lamination or other joining process. For reference, the boundary of seal (100) is shown in FIGS. 3 and 4 in phantom.

Figure 5:
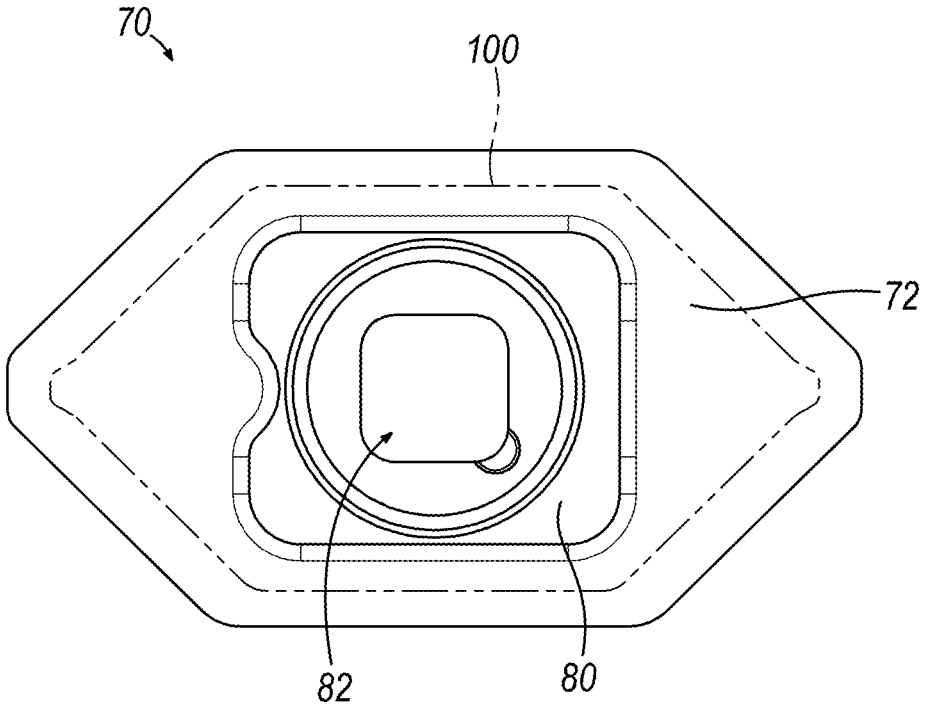
FIG. 5 depicts a bottom plan view of a gusset for formation of the pouch of FIG. 1.
Figure 6:
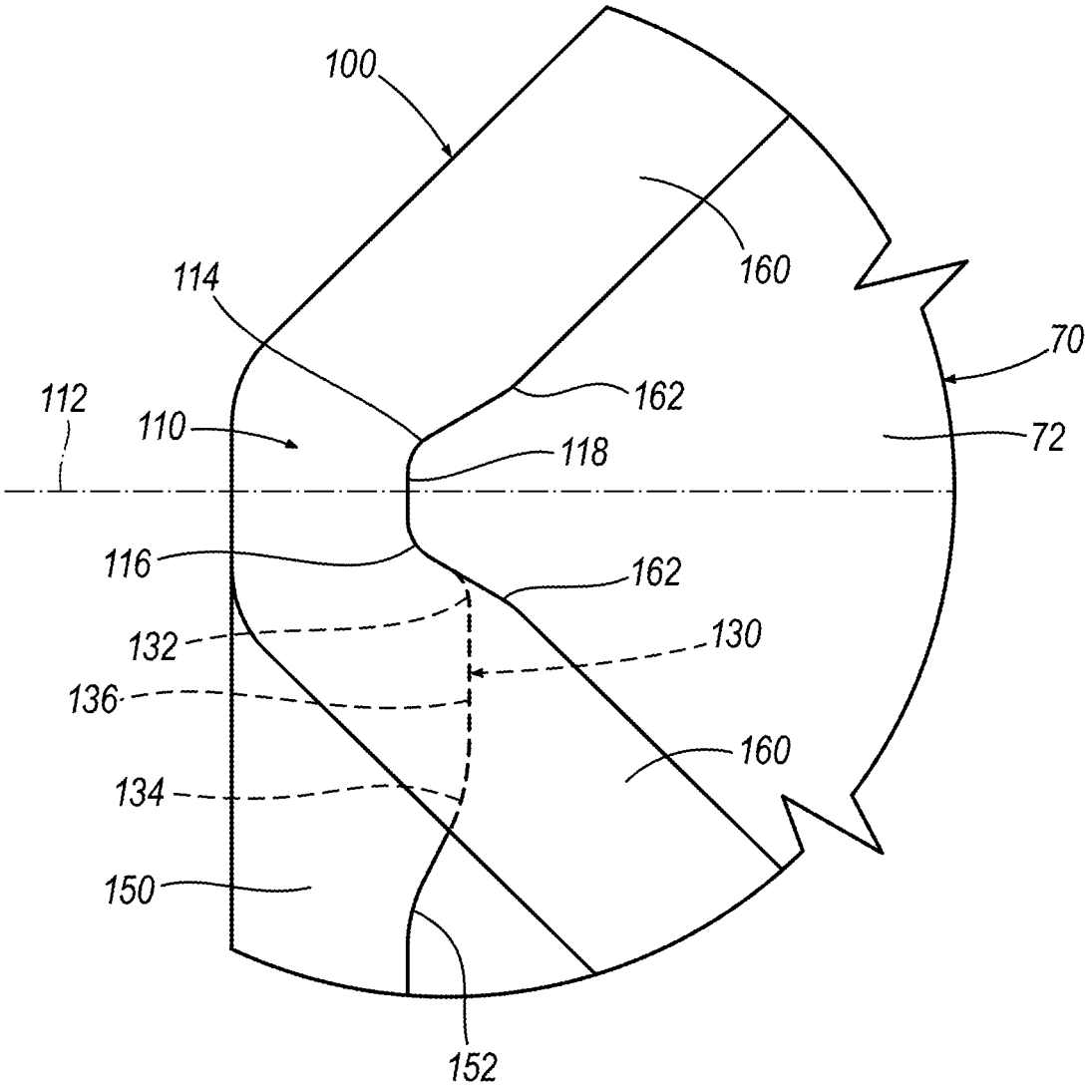
FIG. 6 depicts a detailed schematic view of a seal of the pouch of FIG. 1, the seal including a triple-point seal.

FIG. 5 shows gusset (70) in greater detail. As can be seen, gusset (70) includes a gusset body (72) and a spout portion (80) connects with gusset (70). Gusset body (72) is generally hexagonal in shape with a portion being elongated along one axis, thereby forming an elongated hexagon. The shape of gusset body (72) defines the general footprint of pouch (10). The shape of gusset body (72) further contributes to the general tapered form associated with bottom portion (34, 54) of front sheet (30) and back sheet (50). Although a hexagonal shape is used in the present example, it should be understood that gusset body (72) may define other suitable shapes in other examples.

Spout portion (80) defines a region of pouch (10) for ingress and egress of stored product. Spout portion (80) is configured as a generally square or rectangular protrusion extending from the external surface of gusset body (72). Spout portion (80) additionally defines a port (82) extending through spout portion (80) from one end to the other. Port (82) additionally extends through gusset body (72), thereby defining a path for the communication of stored product from storage area (90) to an exterior of pouch (10). In some versions the location of spout portion (80) is on an outer or exterior surface of pouch (10), in other versions spout portion (80) or a portion of spout portion (80) is mounted, bonded, or welded to an inner or interior surface of pouch (10).

Although not shown, it should be understood that pouch (10) may include a cap or other structure secured to spout portion (80). Such a cap may be used to selectively seal port (82), thereby providing a structure to selectively contain stored product within storage area (90). In some examples, the cap may include one or more movable structures such as a hinged lid to permit selective sealing of port (82). In other examples, the cap can be a unitary structure configured to selectively fasten to spout portion (80). Regardless, it should be understood that spout portion (80) may include a variety of structures to permit engagement with cap. Such structures may be those configured for selective engagement such as threads. Alternatively, such structures may be those configured for permanent or semi-permanent fixation such as snap-fit structures.

Gusset (70) is of generally greater rigidity than front sheet (30) and/or back sheet (50). In some examples, this greater rigidity may be achieved by the material used with gusset (70) being formed of semi-flexible material or composite of multiple materials. In other examples, this may be achieved by the structure of gusset (70) with gusset (70) being thicker and/or including one or more reinforcement structures such as ribs. In still other examples, enhanced rigidity may be provided by a combination of material selection and structural features of gusset (70). Additional rigidity for gusset (70) may be desirable to maintain the structure of port (82) and to support associated structures such as the cap described above. Additional rigidity for gusset (70) may also be desirable to support front sheet (30) and back sheet (50) with pouch (10) positioned in an upright orientation, resting on the structure of gusset (70). Simultaneously, it may be desirable for gusset (70) to have at least some flexibility. Flexibility may be desirable to permit the volume of pouch (10) to increase for storage of stored product within storage area (90) while also permitting a manual decrease in volume for discharge or expulsion of stored product. Additionally, some flexibility may be desirable to permit compaction of pouch (10) for disposal. Suitable semi-flexible materials for gusset (70) may include plastics such as polyethylene, metals such as aluminum, paper products such as wax paper, or various combinations thereof.

It should be understood that gusset (70) may initially be provided in a blank form with gusset (70) being cut and/or molded into the shape as shown in FIG. 5 with only the flat structure of gusset body (72) and the protruding structure of spout portion (80). As will be described in greater detail below, a seal (100) may be added to gusset (70) during manufacturing of pouch (10) using a lamination or other joining process. For reference, the boundary of seal (100) is shown in FIG. 5 in phantom.

As described above, front sheet (30), back sheet (50), and gusset (70) are joined together with a seal (100). Seal (100) generally extends around the perimeter of front sheet (30), back sheet (50), and gusset (70) to define storage area (90) as a fluid tight space between front sheet (30), back sheet (50) and gusset (70). Seal (100) is generally configured as a flat strip where at least two of front sheet (30), back sheet (50) and gusset (70) are joined with a width of between about 6 mm and about 8 mm (plus or minus 1 mm). Seal (100) may be formed by a variety of processes, which may depend on the particular material being joined. For instance, where front sheet (30), back sheet (50) and gusset (70) are a plastic or polymer material, seal (100) can be formed by the application of heat and pressure using one or more seal bars to fuse front sheet (30), back sheet (50) and gusset (70) together using multiple applications of either a single seal bar or multiple seal bars used with single or multiple applications.

Referring to FIG. 5, seal (100) includes a triple-point seal (110), which is formed at an intersection between front sheet (30), back sheet (50), and gusset (70). As described above, triple-point seal (110) may encounter challenges in formation due to the intersection of multiple materials and individual tolerances of those materials pluse manufacturing tolerances and variability. Thus, triple-point seal (110) of the present example includes one or more geometric features to enhance fusion even in the presence of these obstacles. Generally, triple-point seal (110) is configured to include multiple soft landings between intersecting edges of front sheet (30), back sheet (50), and/or gusset (70). As will be described in greater detail below, a soft landing may be characterized as a tapered transition between one edge to another, thereby providing a smooth and gradual transition between edges. Such a smooth and gradual transition between edges may enhance sealing in the presence of material variation in front sheet (30), back sheet (50), and gusset (70) and/or manufacturing variation.

Triple-point seal (110) is generally formed at the transition between a side seal portion (150) of seal (100) and a bottom seal portion (160) of seal (100). Side seal portion (150) is a portion of seal (100) that joins front sheet (30) to back sheet (50). Side seal portion (150) extends upwardly away from triple point seal (110) toward top portions (32, 52) of front sheet (30) and back sheet (50), respectively. In the present example, side seal portion (150) defines a width of about 6 mm, although other suitable widths may be used in other examples.

Bottom seal portion (160) is a portion of seal (100) that joins front sheet (30) or back sheet (50) to gusset (70), depending on the side of gusset (70) being joined to pouch (10). Bottom seal portion (160) extends around the bottom perimeter of pouch (10) near bottom portions (34, 54) of front sheet (30) and back sheet (50), respectively. In the present example, bottom seal portion (160) defines a width of about 7 mm, although other suitable widths may be used in other examples.

As described above, triple-point seal (110) is generally formed at the transition between side seal portion (150) and bottom seal portion (160). This transition may be characterized as including one or more soft landings connecting edges of one of side seal portion (150) or bottom seal portion (160) to the other of side seal portion (150) or bottom seal portion (160). For instance, the present example defines an inflection feature (112) and a bump feature (130), both of which are configured to provide a soft landing between edges.

Inflection feature (112) is defined by the transition between one side of bottom seal portion (160) and the other (e.g., the front and back sides). At this transition, seal (100) defines an inflection point where the internal edge of seal (100) is indented. In the present example, inflection feature (112) is formed by the intersection between a first inflection radius (114) and a second inflection radius (116). Both first inflection radius (114) and second inflection radius (116) define a substantially similar radius dimension. In the present example, the radius dimension for first inflection radius (114) and second inflection radius (116) is about 1.5 mm (plus or minus 10%).

First inflection radius (114) and second inflection radius (116) are separated by a predetermined distance to define an inflection edge (118) between first inflection radius (114) and second inflection radius (116). In the present example, first inflection radius (114) and second inflection radius (116) are separated by a distance of greater than 1.5 mm. In some examples, the separation between first inflection radius (114) and second inflection radius (116) is equal to or greater than 4.5 mm. In yet other examples, the separation between first inflection radius (114) and second inflection radius (116) is 3.5 mm to 5.5 mm. Regardless, it should be understood that the distance of separation is defined by the distance from the center point of the arc of one of the first inflection radius (114) or the second inflection radius (116) to the center point of the arc of the other of the first inflection radius (114) or the second inflection radius (116) respectively.

As seal (100) extends away from inflection feature (112), seal (100) forks into bottom seal portion (160) and side seal portion (150). Bottom seal portion (160) includes a bottom seal radius (162) of about 15 mm to provide gradual transition from inflection feature (112) and bottom seal portion (160). Meanwhile, the transition from inflection feature (112) to side portion (150) includes bump feature (130) disposed between inflection feature (112) and side seal portion (150). Bump feature (130) includes a first bump radius (132) and a second bump radius (134) offset with respect to a respective first inflection radius (114) or second inflection radius (116) to define a protruding edge (136) extending from first bump radius (132) to second bump radius (134). As a result, bump feature (130) defines a width that is greater than the width of side seal portion (150). In the present example, the width of bump feature (130) is 8 mm. In other examples, the width of bump feature (130) may be characterized as a function of the width of side seal portion (150) where the width of bump feature (130) is the width of side seal portion (150) plus about 2 mm.

First bump radius (132) provides a transition from a respective first inflection radius (114) or second inflection radius (116), while second bump radius (134) defines a transition from protruding edge (136) to a side seal radius (152) associated with the inner edge of side seal portion (150). Consequently, first bump radius (132) may define a different radius relative to second bump radius (134). For instance, in the present example, first bump radius (132) is about 2 mm, while second bump radius (134) (and the associated side seal radius) is about 5 mm. In some examples, the particular radius used may be defined by various dimensional characteristics such as the width of side seal portion (150) and/or the offset between protruding edge (136) and inflection edge (118). Thus, where the physical dimensions of seal (100) are reduced or increased, radius of first bump radius (132) and second bump radius (134) may be changed proportionally.

Figure 7B:
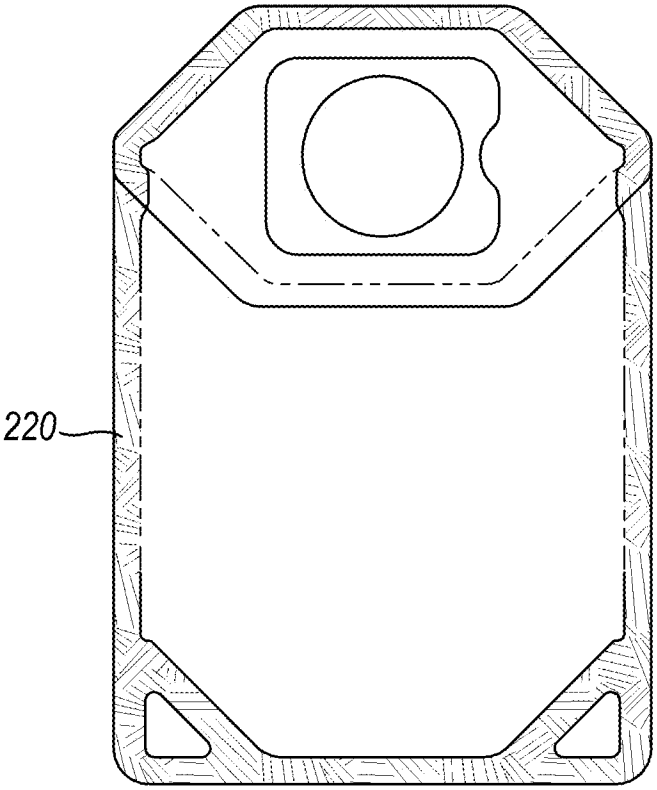
FIG. 7B depicts a schematic view of a second seal bar for formation of the pouch of FIG. 1.
Figure 7A:
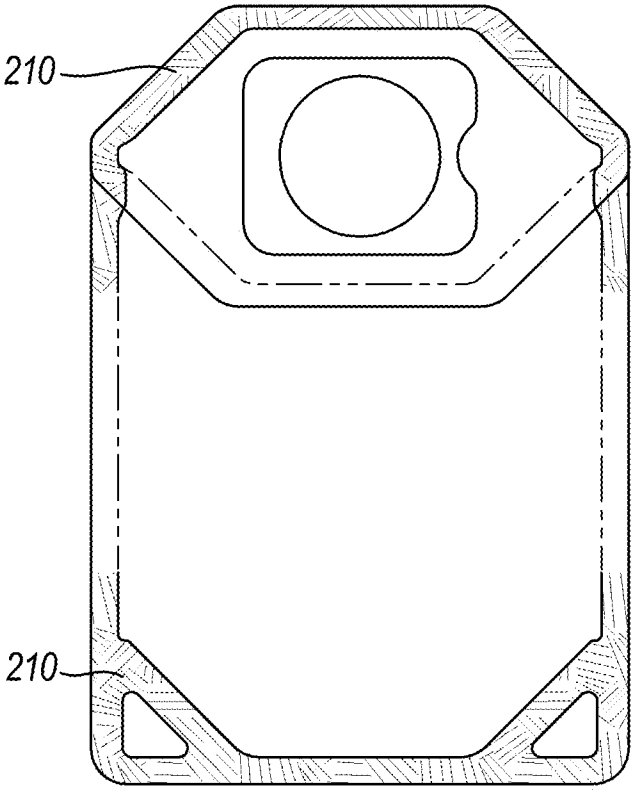
FIG. 7A depicts a schematic view of a first seal bar for formation of the pouch of FIG. 1.
Figure 7C:
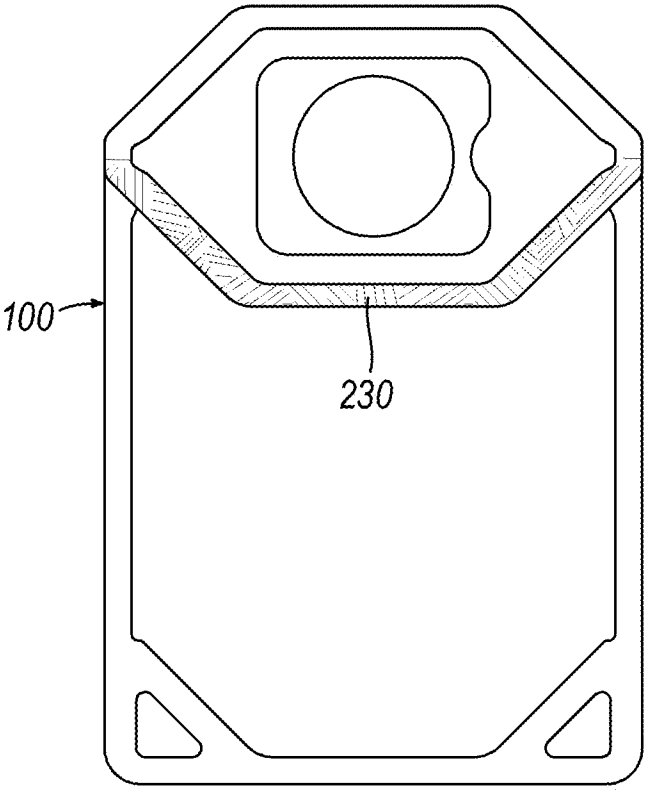
FIG. 7C depicts a schematic view of a third seal bar for formation of the pouch of FIG. 1.

FIGS. 7A through 7C show an illustrative use of a plurality of seal bars for the formation of seal (100) in pouch (10) described above. Prior to formation of seal (100), front sheet (30), back sheet (50), and gusset (70) are provided in bank form as a generally sheet-based material. A series of seal bars (210, 220, 230) are then applied to the combination of front sheet (30), back sheet (50), and gusset (70) in a predetermined sequence with one or more application per seal bar (210, 220, 230) to form pouch (10). As will be understood, each seal bar (210, 220, 230) is used to apply pressure and/or heat to the combination of front sheet (30), back sheet (50), and gusset (70) to fuse front sheet (30), back sheet (50), and/or gusset (70) together at certain predetermined locations to form seal (100). As will be described in greater detail below, in the present example, each seal bar (210, 220, 230) may form only a portion of seal (100), with each seal bar (210, 220, 230) operating in combination to form the entirety of seal. However, in other examples, one or more of seal bars (210, 220, 230) may be used to form or partially form the entirety of seal (100).

Each seal bar (210, 220, 230) includes one or more planar surfaces (or planar surface portions defining one planar surface) configured to apply pressure and/or heat to front sheet (30), back sheet (50), and/or gusset (70) to form at least a portion of seal (100). Thus, each seal bar (210, 220, 230) may include one or more of the geometric features described above in connection with seal (100). This may include, for example, structures such as triple-point seal (110) such as inflection feature (112) including first inflection radius (114), second inflection radius (116), and/or inflection edge (118). In addition, or in the alternative, this may include structures such as bump feature (130) including first bump radius (132), second bump radius (134), and/or protruding edge (136).

As best seen in FIG. 7A, a first seal bar (210) is initially applied to the combination of front sheet (30), back sheet (50), and gusset (70). First seal bar (210) is generally configured to form or partially form only a portion of seal (100). In particular, first seal bar (210) is configured to form an upper portion of seal (100) and a lower portion of seal (100) with a gap between the upper portion and the lower portion. The upper portion of seal (100) formed by first seal bar (210) may correspond to the portion of seal (100) joining top portions (32, 52) of front sheet (30) and back sheet (50). The lower portion of seal (100) formed by first seal bar (210) may correspond to a portion of triple-point seal (110), at least a portion of side seal portion (150), and at least a portion of bottom seal portion (160). In the present example, first seal bar (210) is used for a single application to the combination of front sheet (30), back sheet (50), and gusset (70). Although in other examples, first seal bar (210) may be used for multiple applications to the combination of front sheet (30), back sheet (50), and gusset (70).

Next, as best seen in FIG. 7B, a second seal bar (220) is applied to the combination of front sheet (30), back sheet (50), and gusset (70). Second seal bar (220) is configured to generally correspond to the entire outer perimeter of seal (100). This includes some overlap with the portion of seal (100) formed by first seal bar (210). Overlapping areas of one or more seal bars (210, 220, 230) may be desirable in some examples to control the fusion characteristics imparted to seal (100). In the present example, second seal bar (220) is applied to the combination of front sheet (30), back sheet (50), and gusset (70) twice. In other words, second seal bar (220) is pressed against the combination of front sheet (30), back sheet (50), and gusset (70) once, then released for a predetermined interval, then pressed against the combination of front sheet (30), back sheet (50), and gusset (70) again. Although the present example uses multiple applications of second seal bar (220), it should be understood that only a single application may be used in other examples.

Next, as best seen in FIG. 7C, a third seal bar (230) is applied to the combination of front sheet (30), back sheet (50), and gusset (70). Third seal bar (230) is generally configured to correspond to a limited portion of triple-point seal (110). In particular, third seal bar (230) of the present example corresponds to a portion of bottom seal portion (160) and the entirely of inflection feature (112). As with second seal bar (220) described above, third seal bar (230) is applied to the combination of front sheet (30), back sheet (50), and gusset (70) twice. Although the present example uses multiple applications of third seal bar (230), it should be understood that only a single application may be used in other examples.

After the second application of third seal bar (230), seal (100) is completed, thereby defining the structure of pouch (10). After completion of seal (100) other steps may be performed to finalize pouch (10) for the receipt of stored products. This may include, for example, attaching other features such as a cap, spout element, or other associated parts. After complete assembly, pouch (10) may be filled with stored product and then be subjected to further processing as desired depending on the nature of the stored product.

EXEMPLARY COMBINATIONS

Example 1: A pouch-type container includes a front sheet, a rear sheet, a bottom gusset where the front sheet, the rear sheet, and the bottom gusset are configured to define a storage area for containing a packaged substance between the front sheet, the rear sheet, and the bottom gusset. The container also includes a seal defined by the front sheet, the rear sheet, the bottom gusset, or a combination thereof, and includes a triple-point defined by at least a portion of the seal at an intersection between the front sheet, the rear sheet, and the bottom gusset. The triple-point includes an inflection feature, the inflection feature including a first inflection radius and a second inflection radius. The first inflection radius is separated from the second inflection radius by a distance greater than 1.5 mm.

Example 2: The container of Example 1 further including the triple-point having a plurality of interconnected edges, each interconnected edge defining a soft landing to transition from one interconnected edge to another.

Example 3: The container of Example 2 where each soft landing is defined by a radius, and the radius of each soft landing is 1.5 mm or more.

Example 4: The container of any one or more of Examples 1 through Example 3 where the triple-point further includes a bump feature disposed proximate the inflection feature. The bump feature defines a seal width greater than a minimum seal width defined by the inflection feature.

Example 5: The container of Example 4 where the seal width of the bump feature is 8 mm, and the minimum seal width of the inflection feature is 6 mm.

Example 6: The container of any one or more of Example 4 through Example 5 where the bump feature is connected to the inflection feature by a first bump radius.

Example 7: The container of any one or more of Example 4 through Example 5 where the seal further includes a side seal portion, the bump feature is disposed between the inflection feature and the side seal portion, the bump feature is also connected to the inflection feature by a first bump radius, the bump feature is further also connected to the side seal portion by a second bump radius such that a portion of the bump feature protrudes with respect to at least a portion of the inflection feature and the side seal portion.

Example 8: The container of Example 7, the first bump radius is about 2 mm and the second bump radius is about 5 mm.

Example 9: The container of any one or more of Example 7 through Example 8 where the side seal portion defines a side seal width of about 6 mm.

Example 10: The container of any one or more of Example 1 through Example 9 where the first inflection radius is separated from the second inflection radius by a distance between about 3.5 mm and 5.5 mm.

Example 11: The container of any one or more of Example 1 through Example 9 where the first inflection radius is separated from the second inflection radius by a distance of 4.5 mm or more.

Example 12: The container of any one or more of Example 1 through Example 9 where the first inflection radius is separated from the second inflection radius by a distance of about 4.5 mm.

Example 13: The container of any one or more of Example 1 through Example 12, where the first inflection radius and the second inflection radius have a radius of about 1.5 mm.

Example 14: A method for manufacturing a pouch-like container includes applying a first seal bar to a front sheet, a back sheet, and a gusset to form a seal therein. The first seal bar forms an upper portion of the seal and a lower portion of the seal with a gap between the upper portion and the lower portion. The lower portion of the seal includes a triple-point sealing an interface between the first sheet, the back sheet, and the gusset. The method further includes applying a second seal bar to the front sheet, the back sheet, and the gusset to form the seal therein. The second seal bar forming an outer perimeter of the seal where the outer perimeter includes at least a portion of the upper portion, the lower portion and the triple-point of the seal. The method further including applying a third seal bar to the front sheet, the back sheet, and the gusset to form the seal therein. The third seal bar forming a portion of the seal including the triple-point and a bottom seal portion.

Example 15: The method of Example 14 where the step of applying the second seal bar is performed twice.

Example 16: The method of any one or more of Example 14 through Example 15 where the step of applying the third seal bar is performed twice.

Example 17: The method of any one or more of Example 14 through Example 16 where the step of applying the first seal bar is performed before the step of applying the second seal bar, and the step of applying the second seal bar is performed before the step of applying the third seal bar.

It should be understood that any one or more of the teachings, embodiments, examples, etc. described herein may be combined with any one or more of the other teachings, embodiments, examples, etc. that are described herein. The teachings, embodiments, examples, etc. described herein should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various examples of the present invention, further adaptations of the methods and systems described herein may be accomplished by appropriate modifications by one of ordinary skill in the art without departing from the scope of the present invention. Accordingly, the scope of the present invention should be considered in terms of the following claims and is understood not to be limited to the details of structure and operation shown and described in the specification and drawings.

I claim:

1. A pouch-type container, the container comprising:

(a) a front sheet;

(b) a rear sheet;

(c) a bottom gusset, the front sheet, the rear sheet, and the bottom gusset being configured to define a storage area for containing a packaged substance between the front sheet, the rear sheet, and the bottom gusset;

(d) a seal defined by the front sheet, the rear sheet, the bottom gusset, or a combination thereof; and (e) a triple-point defined by at least a portion of the seal at an intersection between the front sheet, the rear sheet, and the bottom gusset, the triple-point including an inflection feature, the inflection feature including a first inflection radius and a second inflection radius, the first inflection radius being separated from the second inflection radius by a distance greater than 1.5 mm.

2. The container of claim 1, the triple-point including a plurality of interconnected edges, each interconnected edge defining a soft landing to transition from one interconnected edge to another.

3. The container of claim 2, each soft landing being defined by a radius, the radius of each soft landing being 1.5 mm or more.

4. The container of claim 1, the triple-point further including a bump feature disposed proximate the inflection feature, the bump feature defining a seal width greater than a minimum seal width defined by the inflection feature.

5. The container of claim 4, the seal width of the bump feature being 8 mm, the minimum seal width of the inflection feature being 6 mm.

6. The container of claim 4, the bump feature being connected to the inflection feature by a first bump radius.

7. The container of claim 4, the seal further including a side seal portion, the bump feature being disposed between the inflection feature and the side seal portion, the bump feature being connected to the inflection feature by a first bump radius, the bump feature being connected to the side seal portion by a second bump radius such that a portion of the bump feature protrudes with respect to at least a portion of the inflection feature and the side seal portion.

8. The container of claim 7, the first bump radius being about 2 mm, the second bump radius being about 5 mm.

9. The container of claim 7, the side seal portion defining a side seal width, the side seal width being about 6 mm.

10. The container of claim 1, the first inflection radius being separated from the second inflection radius by a distance between about 3.5 mm and 5.5 mm.

11. The container of claim 1, the first inflection radius being separated from the second inflection radius by a distance of 4.5 mm or more.

12. The container of claim 1, the first inflection radius being separated from the second inflection radius by a distance of about 4.5 mm.

13. The container of claim 1, the first inflection radius and the second inflection radius having a radius of about 1.5 mm.

* * * * *